US011226169B2

(12) United States Patent
Leslie et al.

(10) Patent No.: US 11,226,169 B2
(45) Date of Patent: Jan. 18, 2022

(54) HANDGUARD ASSEMBLY

(71) Applicants: Jimi Leslie, San Diego, CA (US); Andrew Bedwell, San Diego, CA (US)

(72) Inventors: Jimi Leslie, San Diego, CA (US); Andrew Bedwell, San Diego, CA (US)

( * ) Notice: Subject to any disclaimer, the term of this patent is extended or adjusted under 35 U.S.C. 154(b) by 0 days.

(21) Appl. No.: 16/790,708

(22) Filed: Feb. 13, 2020

(65) Prior Publication Data

US 2020/0256637 A1 Aug. 13, 2020

Related U.S. Application Data

(60) Provisional application No. 62/805,071, filed on Feb. 13, 2019.

(51) Int. Cl.
*F41C 23/16* (2006.01)
*F41G 1/54* (2006.01)

(52) U.S. Cl.
CPC ..... *F41C 23/16* (2013.01); *F41G 1/545* (2013.01)

(58) Field of Classification Search
CPC ..... F41C 23/16
USPC ..... 42/71.01, 72
See application file for complete search history.

(56) References Cited

U.S. PATENT DOCUMENTS

2013/0276341 A1* 10/2013 Wells ..... F41G 11/003 42/71.01

* cited by examiner

*Primary Examiner* — Reginald S Tillman, Jr.
(74) *Attorney, Agent, or Firm* — Kevin Keener; Stephen Presutti

(57) ABSTRACT

A handguard assembly for attaching to a firearm is disclosed. The handguard assembly comprises an upper component, a lower component, a front cap, and a rear cap. The front cap and rear cap are secured within the lower component. The front cap and rear cap have curved top sides for supporting the barrel of the firearm. The lower component has slots in the sides to receive tabs from the sides of the upper component. When the upper component and lower component are attached to the firearm, the components work together to position the barrel in the preferred position so that the sights of the firearm are zeroed when the handguard assembly is attached to the firearm.

18 Claims, 24 Drawing Sheets

HANDGUARD ASSEMBLY

PRIORITY

This application claims priority to U.S. Provisional Patent Application Ser. No. 62/805,071, filed on Feb. 13, 2019, the disclosure of which is hereby fully incorporated by reference.

FIELD OF THE INVENTION

The present disclosure relates generally to handguards, and more particularly, to functional handguards that reduce inaccuracy and are easily installed for the AR-15 style rifle.

BACKGROUND OF INVENTION

Handguards are guards that are attached to the front of a firearm to provide for grip and protection. Individuals may find themselves grabbing a firearm's barrel when firing for stability. Said barrel can become extremely heated and cause burns on the user's hand. Guards eliminate this risk. Furthermore, guards can enable additional attachments to the firearm itself.

Handguards, however, are not perfect. Using handguards can cause an increase in firearm weight. By increasing the weight of the firearm, maneuvers can be hindered, disrupted, or in fact impossible. An increase in weight can also effect aiming precision. Furthermore, by nature, a handguard may alter the accuracy of the firearm.

Users will use the sights of a firearm to ensure firing accuracy. Sights typically involve a rear sight and forward sight that the user must align to be able to pinpoint a firing target location. The forward sight is typically mounted on the barrel of firearm while the rear sight is mounted on the upper receiver of the firearm. Ensuring that the sights are in proper alignment can be difficult. A user must make an assumption that the sights are in alignment but begin the process of adjusting and zeroing in the sights through use of the firearm. What is needed is a handguard system for installing on a firearm that automatically forces the barrel into the predetermined position so that the sights are automatically zeroed when the handguard is attached to the firearm.

SUMMARY OF THE INVENTION

The following presents a simplified summary in order to provide a basic understanding of some aspects of the disclosed innovation. This summary is not an extensive overview, and it is not intended to identify key/critical elements or to delineate the scope thereof. Its sole purpose is to present some concepts in a simplified form as a prelude to the more detailed description that is presented later.

The invention is directed toward a handguard assembly for a firearm comprising an upper component comprising a top portion connected to a first side wall and a second side wall; an internal cavity defined by said first side wall and said second side wall; wherein said first side wall has one or more tabs disposed at a bottom end; wherein said second side wall has one or more tabs disposed at a bottom end; a front opening; a rear opening; a lower component comprising a first side; a second side disposed adjacent to said first side; an opening along a length of said lower component defined by said first side and said second side; wherein said first side has one or more slots disposed in said first side; wherein said second side has one or more slots disposed in said second side; a front cap having a curved top side; a rear cap having a curved top side; wherein said one or more tabs of said first side wall of said upper component are removably disposed within said one or more slots of said first side of said lower component; wherein said one or more tabs of said second side wall of said upper component are removably disposed within said one or more slots of said second side of said lower component; wherein said upper component and said lower component position a barrel of said firearm into a position where said firearm is in a zero sights state.

In another embodiment said first side wall of said upper component and said first side of said lower component are joined at a non-perpendicular angle; and said second side wall of said upper component and said second side of said lower component are joined at a non-perpendicular angle.

In another embodiment a first distance between said one or more tabs on said first side wall of said upper component and said one or more tabs on said second side wall of said upper component is less than a second distance between said one or more slots in said first side of lower component and said one or more slots in said second side of said lower component. Said front cap and said rear cap may be disposed within an internal cavity of said lower component. Said front cap and said rear cap may be removably secured to said lower component with a plurality of screws.

A top front edge of said front opening of said upper component may be lower than a top rear edge of said rear opening of said upper component when said handguard assembly is attached to said firearm. Said top side of said front cap may be higher than said top side of said rear cap when said handguard assembly is attached to said firearm.

Still other embodiments of the present invention will become readily apparent to those skilled in this art from the following description wherein there is shown and described the embodiments of this invention, simply by way of illustration of the best modes suited to carry out the invention. As it will be realized, the invention is capable of other different embodiments and its several details are capable of modifications in various obvious aspects all without departing from the scope of the invention. Accordingly, the drawing and descriptions will be regarded as illustrative in nature and not as restrictive.

BRIEF DESCRIPTION OF THE DRAWINGS

Various exemplary embodiments of this invention will be described in detail, wherein like reference numerals refer to identical or similar components, with reference to the following figures, wherein.

DETAILED DESCRIPTION OF THE PREFERRED EMBODIMENT

Figure 1:
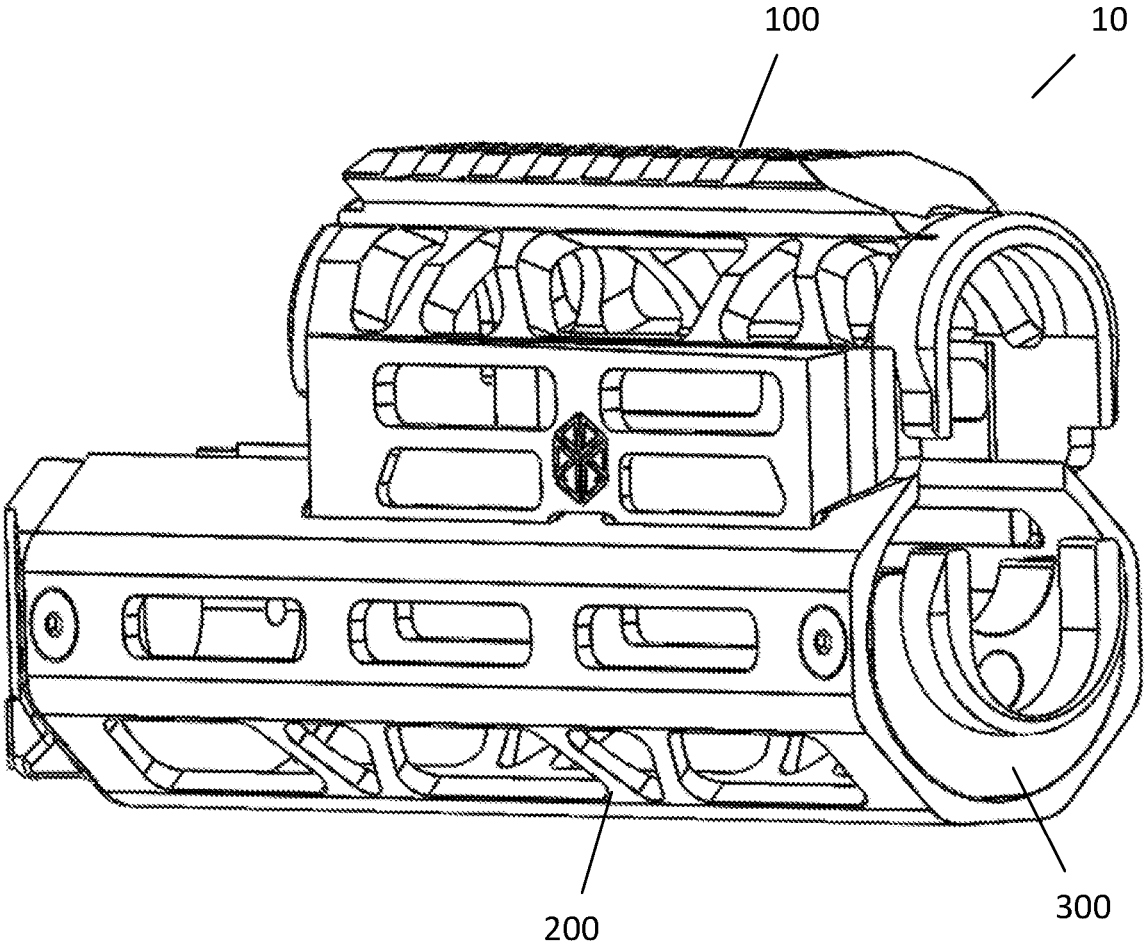
FIG. 1 is a side perspective view of the handguard assembly.
Figure 2:
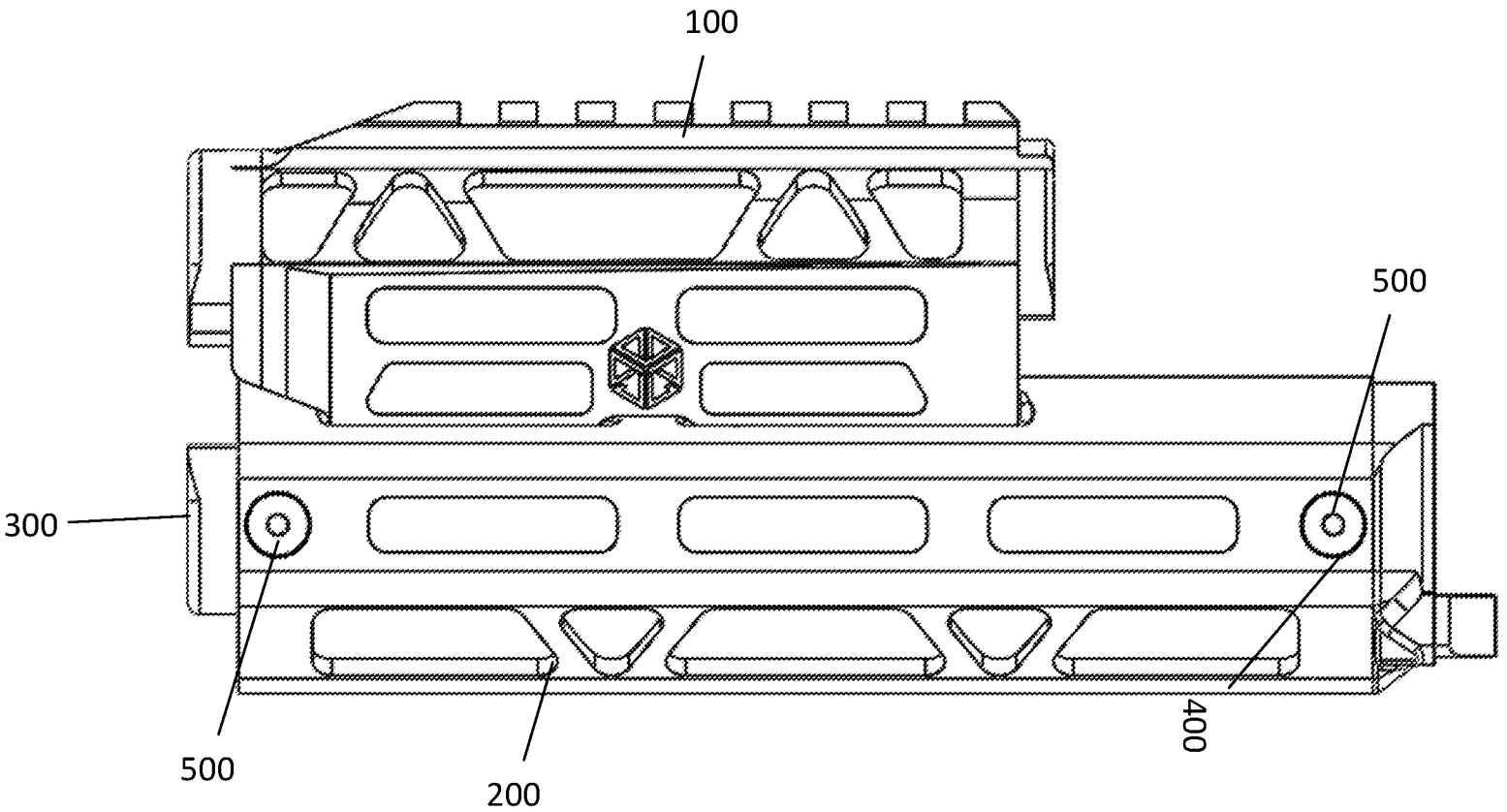
FIG. 2 is a left side view of the handguard assembly.
Figure 3:
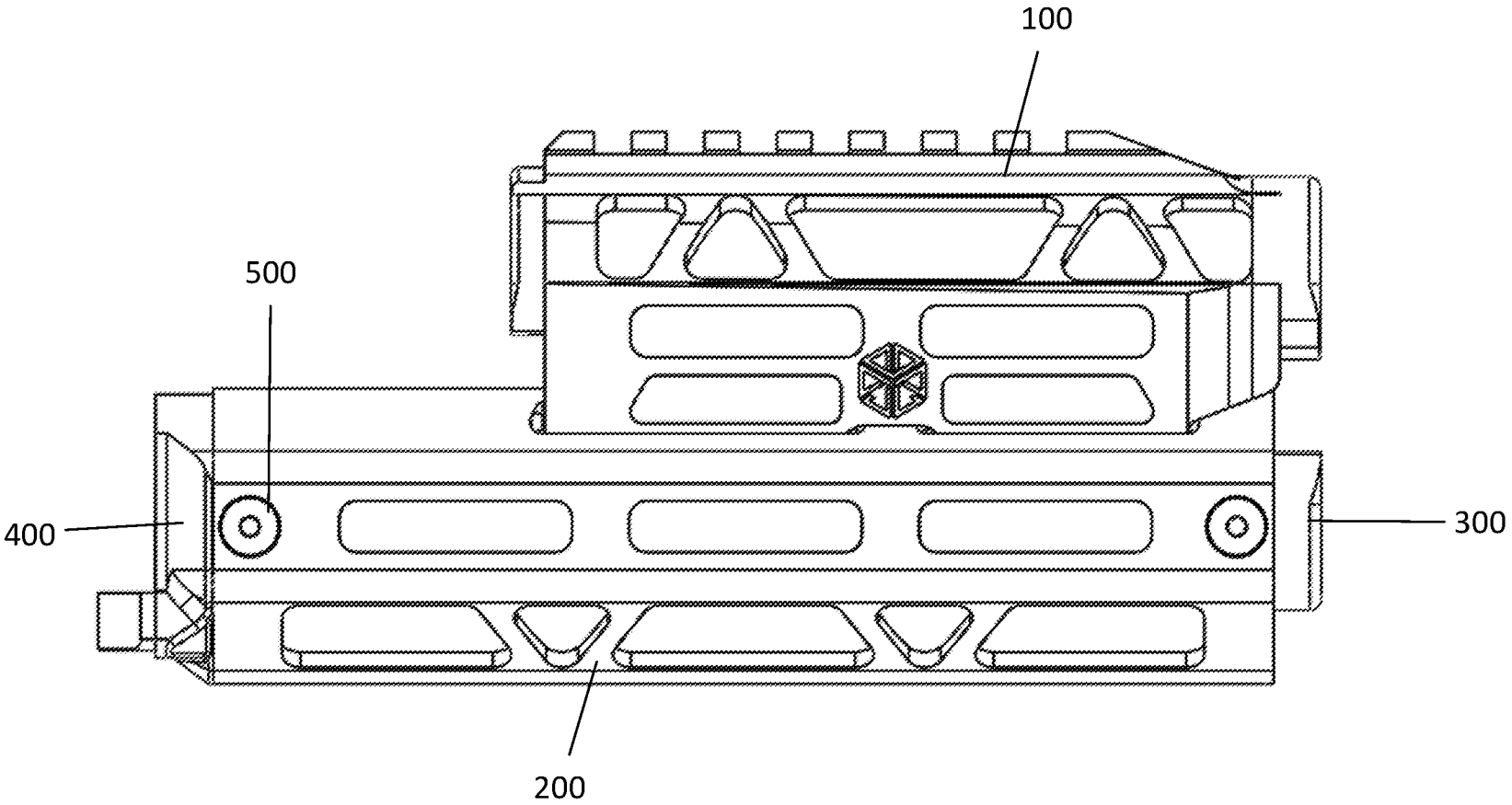
FIG. 3 is a right side view of the handguard assembly.
Figure 4:
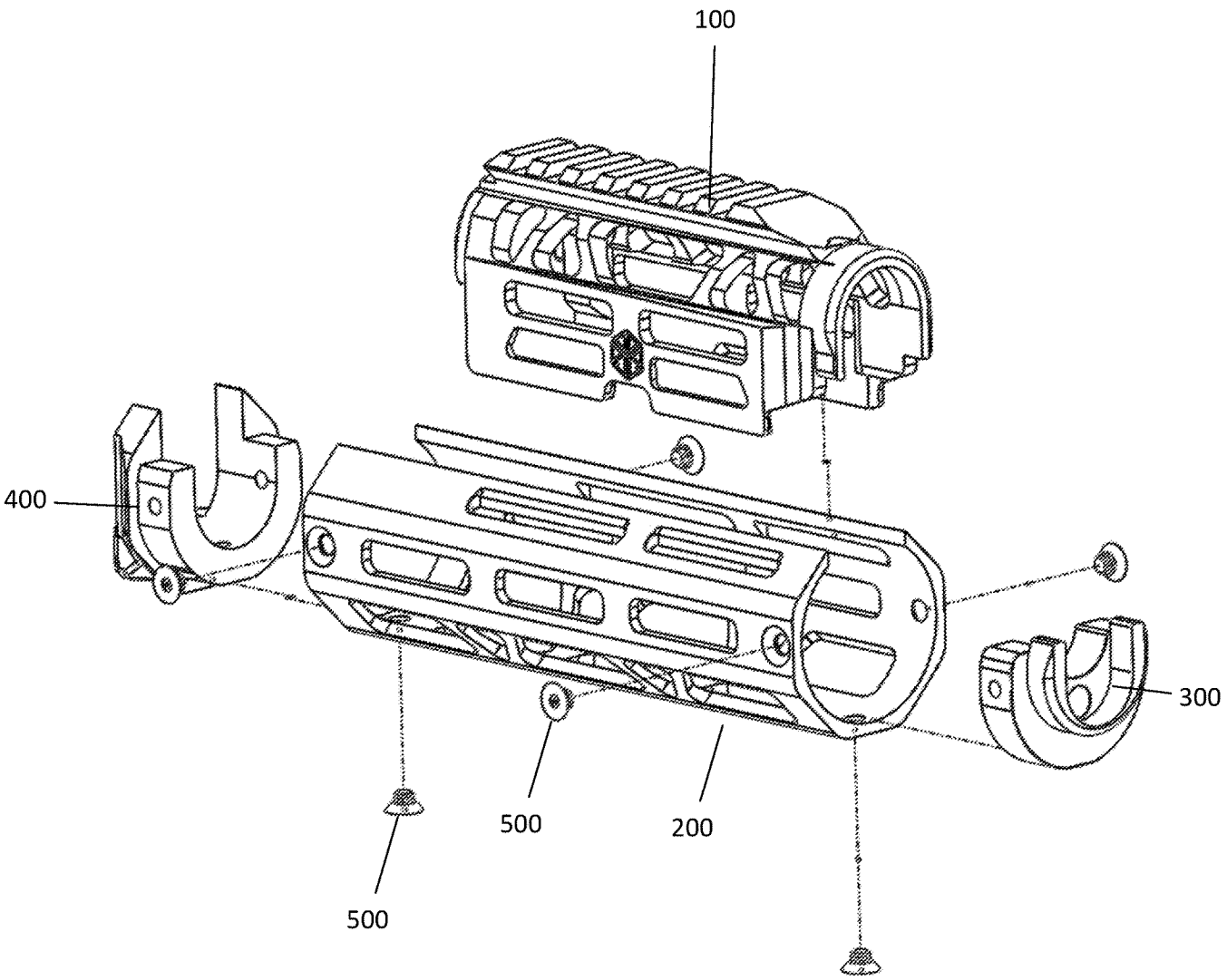
FIG. 4 is an exploded view of the handguard assembly.

The claimed subject matter is now described with reference to the drawings. In the following description, for purposes of explanation, numerous specific details are set forth in order to provide a thorough understanding of the claimed subject matter. It may be evident, however, that the claimed subject matter may be practiced with or without any combination of these specific details, without departing from the spirit and scope of this invention and the claims.

Referring to FIGS. 1-4 the preferred embodiment of the handguard assembly 10 is illustrated. The handguard assembly 10 can be any size and shape and made out of any number of components. In the preferred embodiment the handguard assembly 10 comprises an upper component 100, a lower component, 200, a front cap 300, a rear cap 400, and a plurality of screws 500.

Figure 5:
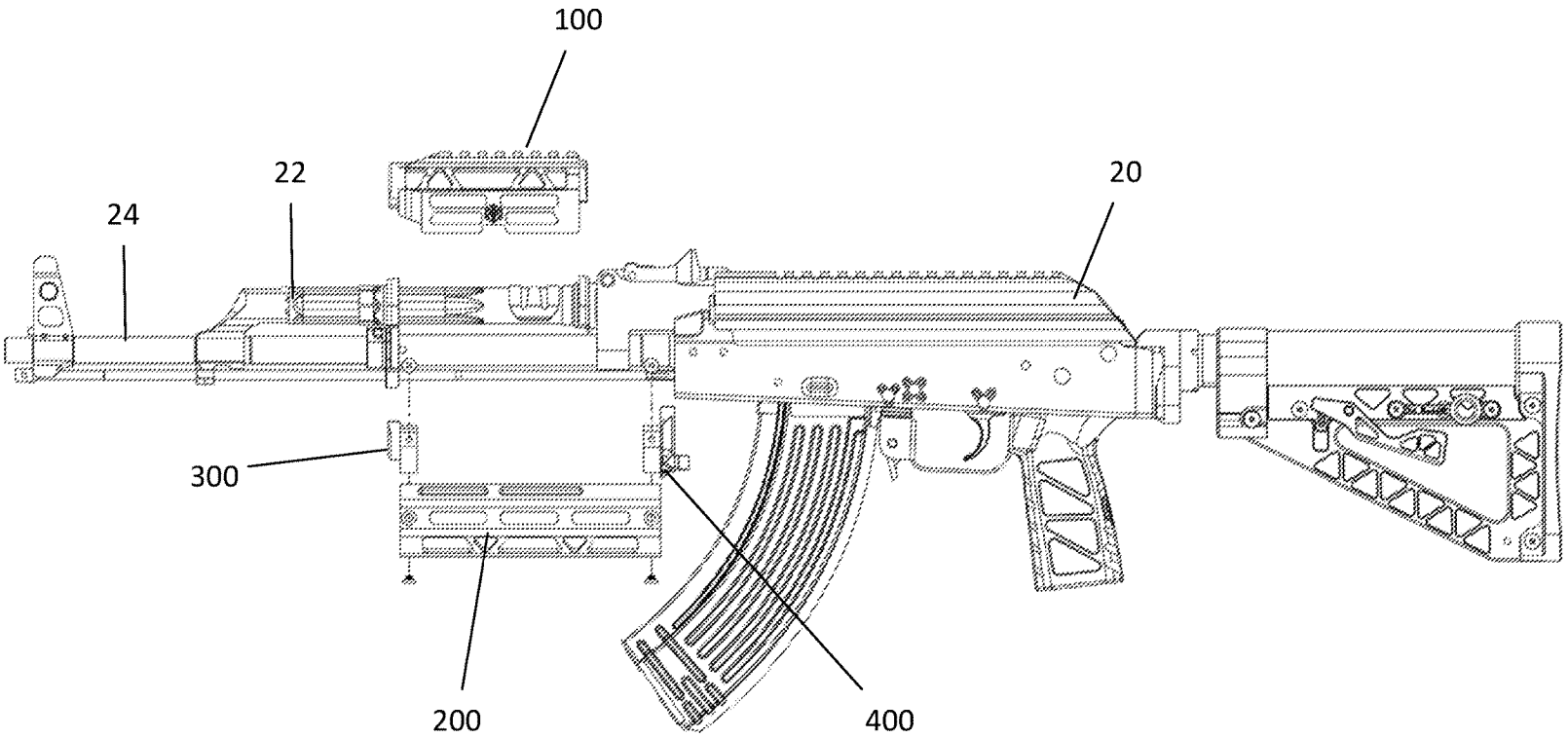
FIG. 5 is an exploded side view of the handguard assembly attached to a firearm.
Figure 6:
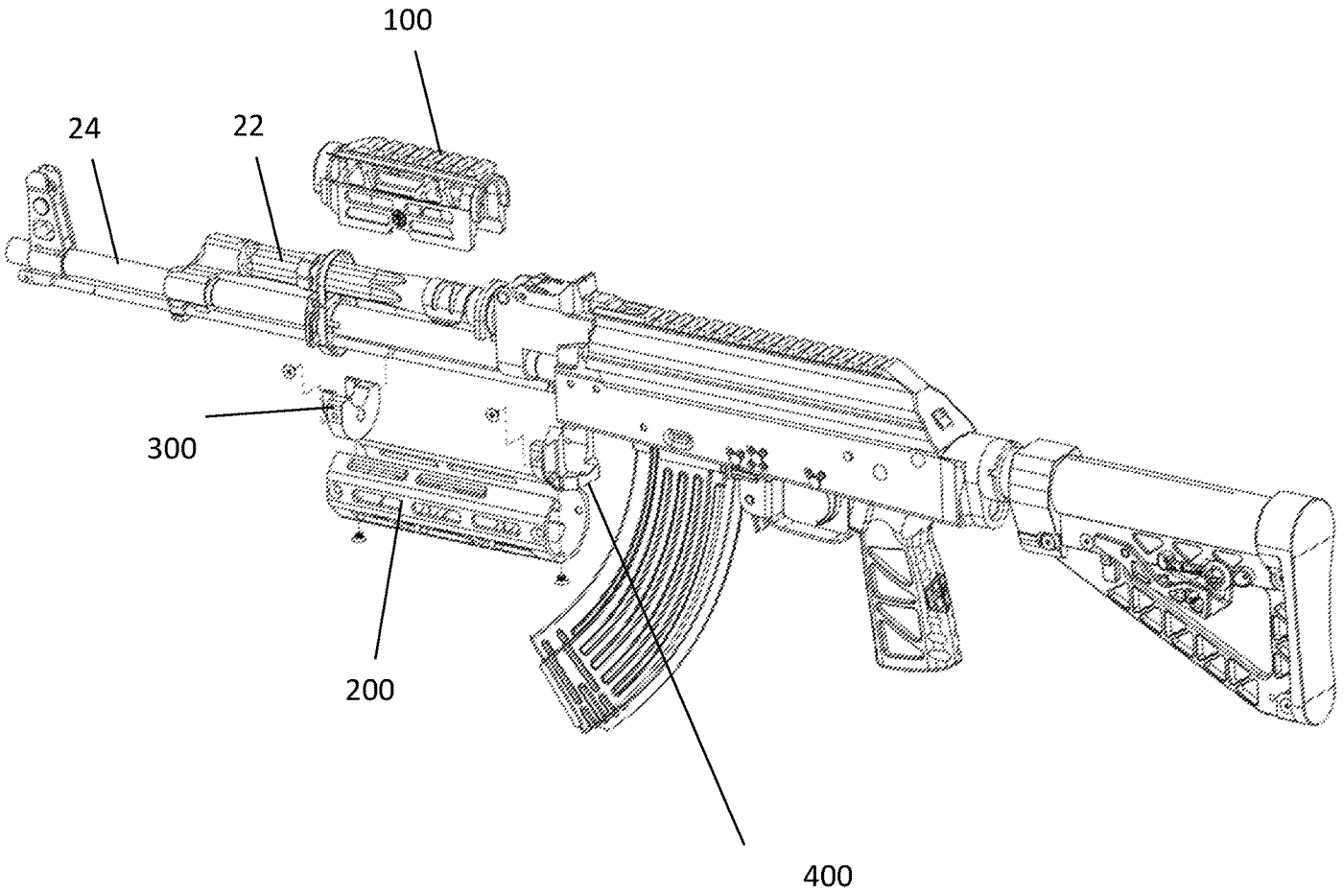
FIG. 6 is an exploded perspective view of the handguard assembly attached to a firearm.
Figure 7:
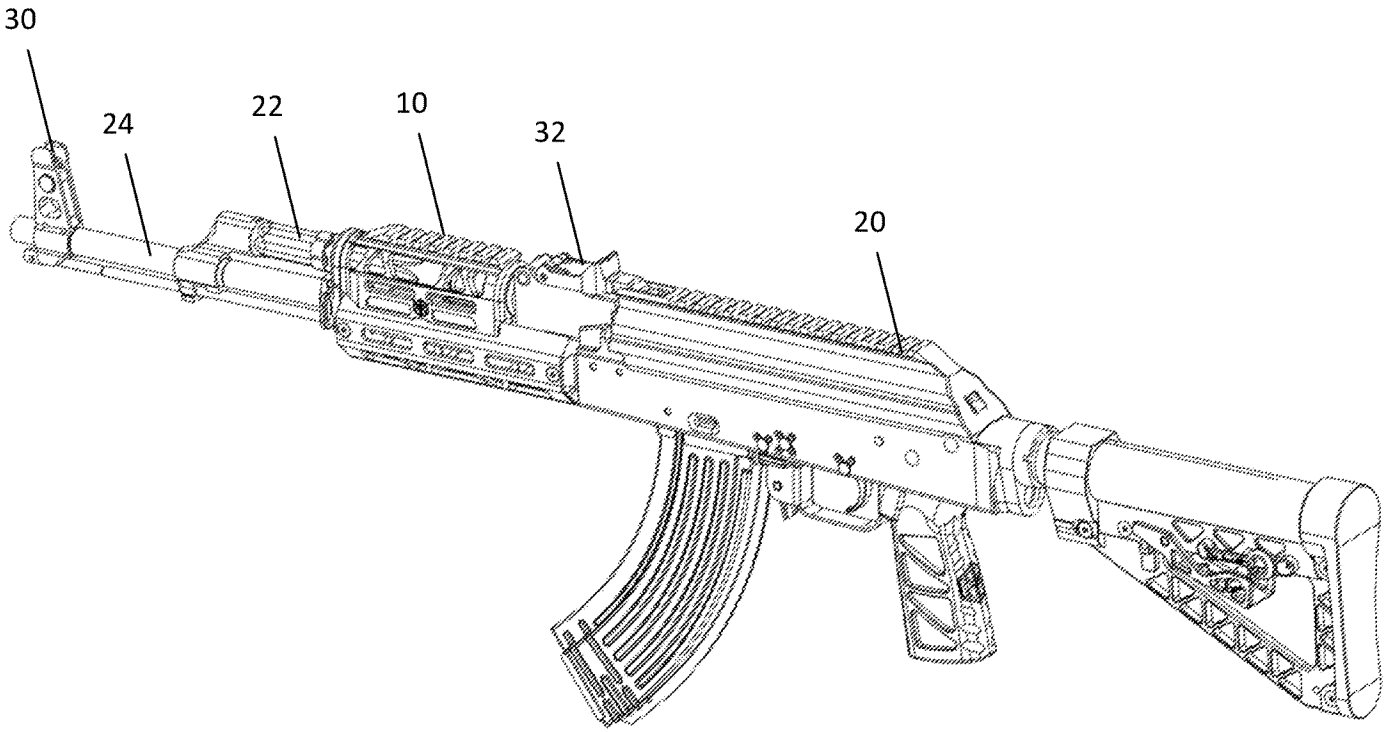
FIG. 7 is a perspective view of the handguard assembly attached to a firearm.

As shown in FIGS. 5-7, the handguard assembly 10 is mounted onto the front end of a firearm 20. The upper component 100 is positioned on top of the gas tube 22. The rear cap 400 attaches to the bottom receiver of the firearm 20. The front cap 300 attaches to the barrel 24 of the firearm 20. The bottom component 200 attaches to the front cap 300 and rear cap 400 by the plurality of screws 500. The upper component 100 attaches to the lower component 200 when fully attached to the firearm 20. The handguard assembly 10 positions the gas tube 22 and barrel 24 into the correct positions so that the front sight 30 and rear sight 32 are zeroed when the handguard assembly 10 is attached to the firearm 20.

Figure 8:
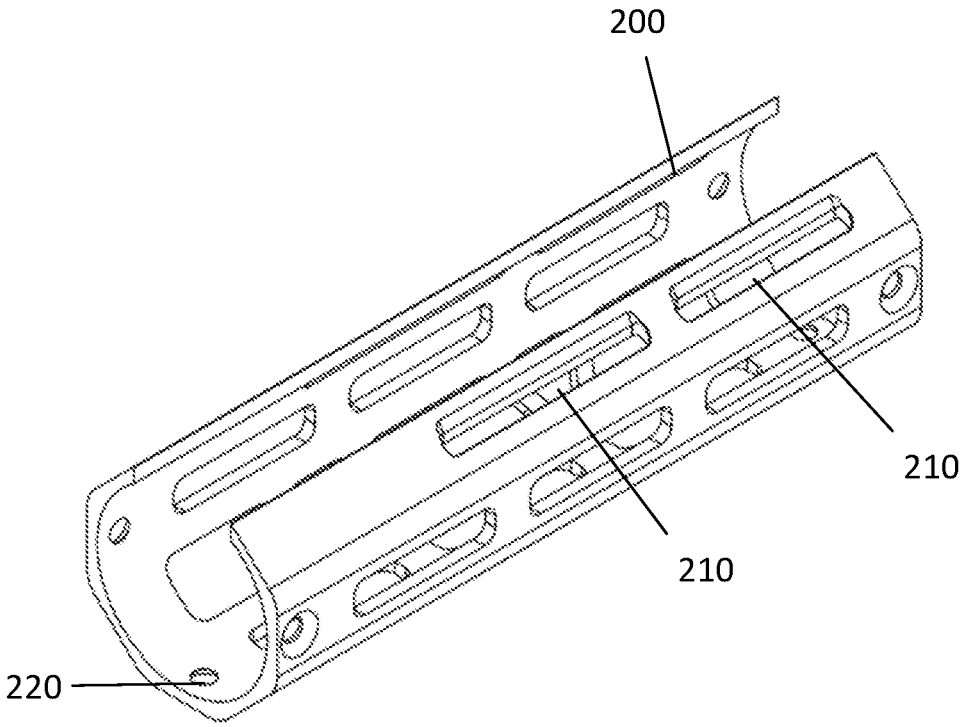
FIG. 8 is an upper perspective view of the lower component of the handguard assembly.
Figure 9A:
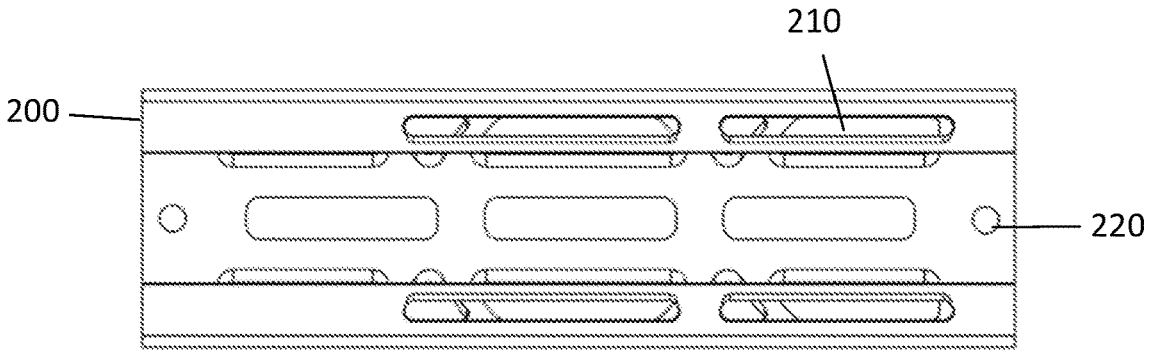
FIG. 9A is a top view of the lower component of the handguard assembly.
Figure 9B:
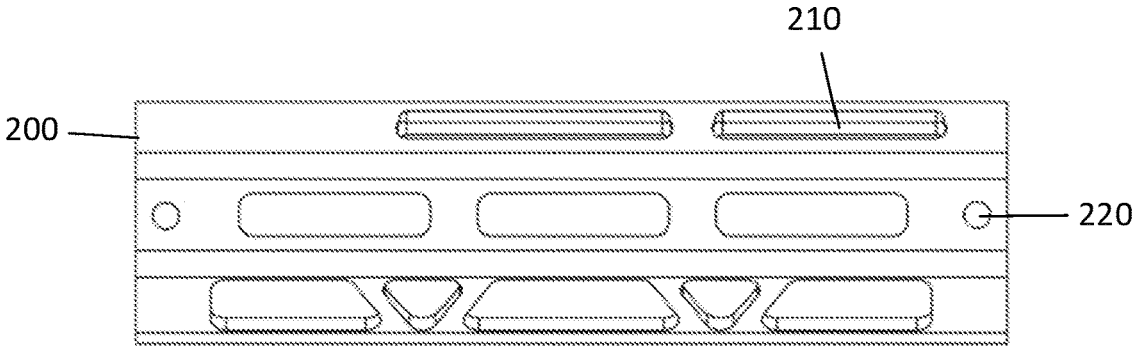
FIG. 9B is a side view of the lower component of the handguard assembly.
Figure 9C:
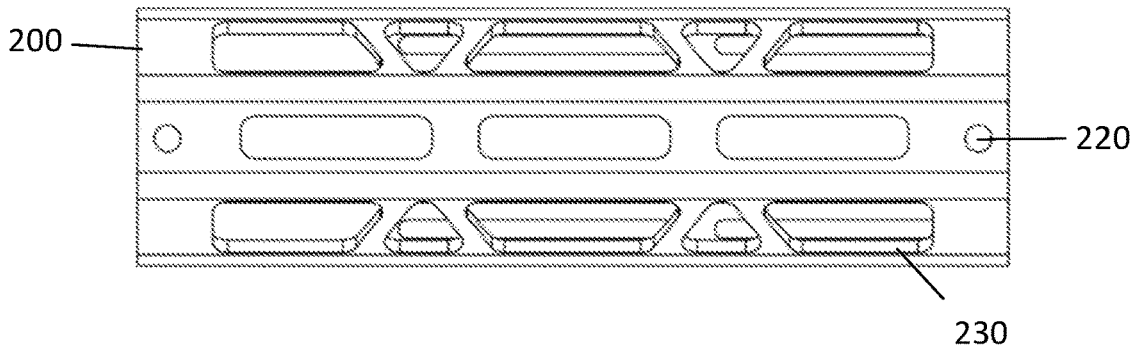
FIG. 9C is a bottom view of the lower component of the handguard assembly.

Referring to FIGS. 8-9C, the lower component 200 is illustrated. The lower component 200 may be any size and shape and include any number of portions or components. The lower component 200 is a generally cylindrical member. The lower component 200 has screw holes 220 for receiving the screws 500. The lower component 200 has an opening at the top for positioning the lower component 200 on the barrel 22. The top end of the lower component 200 is angled relative to the sides. The top end has one or more slots 210 positioned on each side of the top opening. On the bottom side of the lower component may be one or more apertures 230. The apertures 230 may be any size and shape. The apertures 230 permit a user to hang the firearm on a rack and permit the user to grasp the firearm by the lower component 200.

Figure 10:
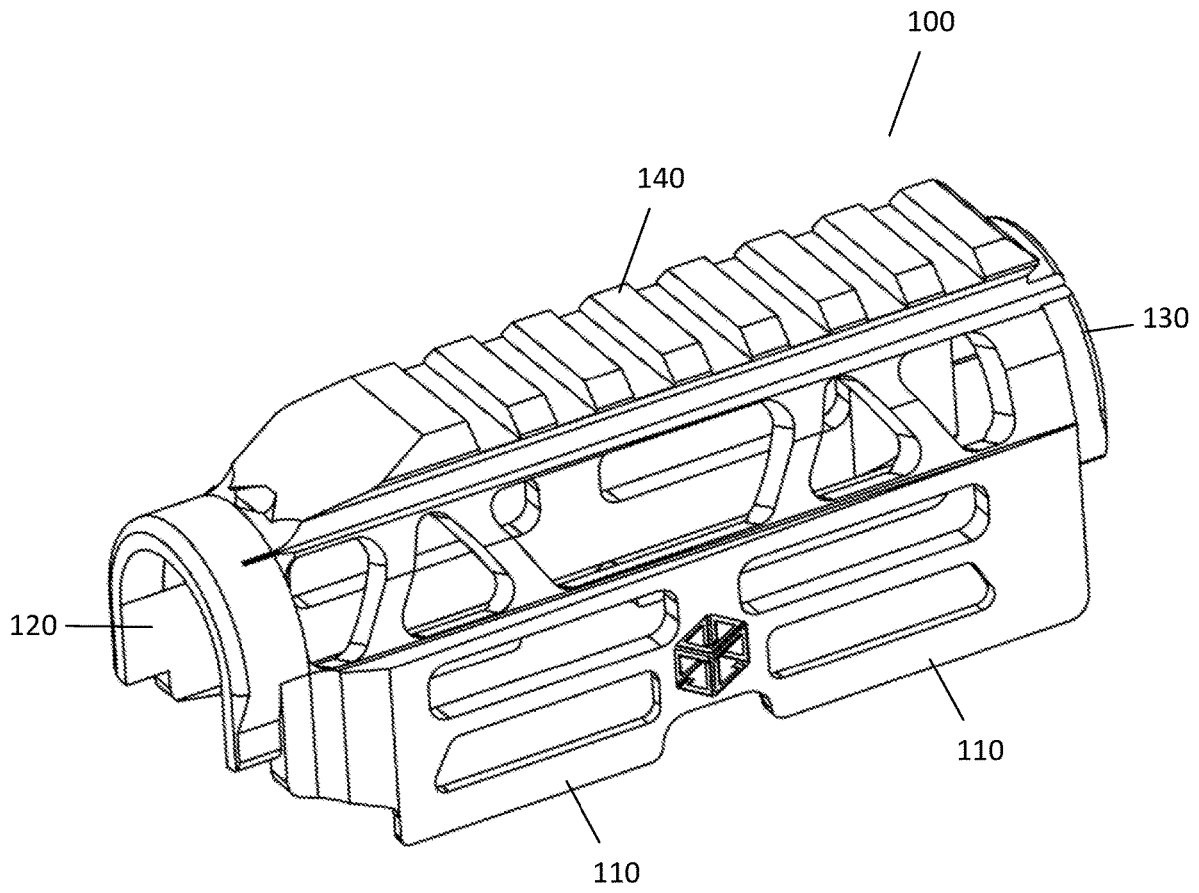
FIG. 10 is a top perspective view of the upper component of the handguard assembly.
Figure 11A:
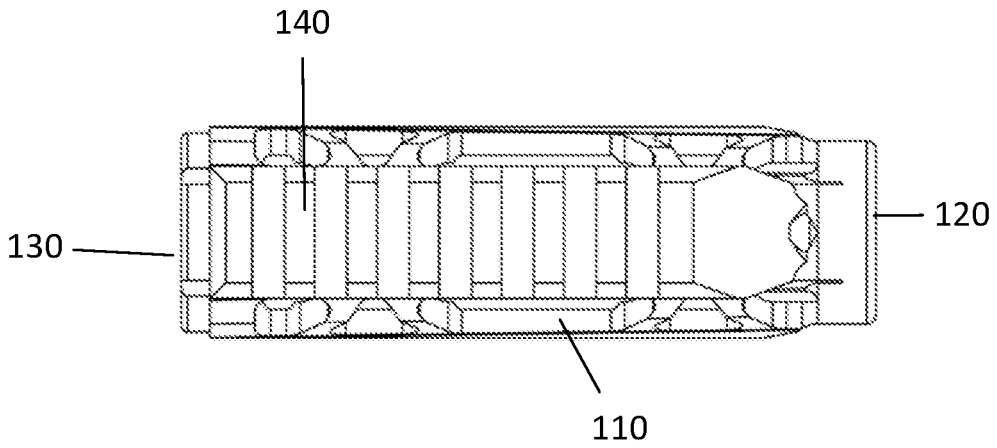
FIG. 11A is a top view of the upper component of the handguard assembly.
Figure 11B:
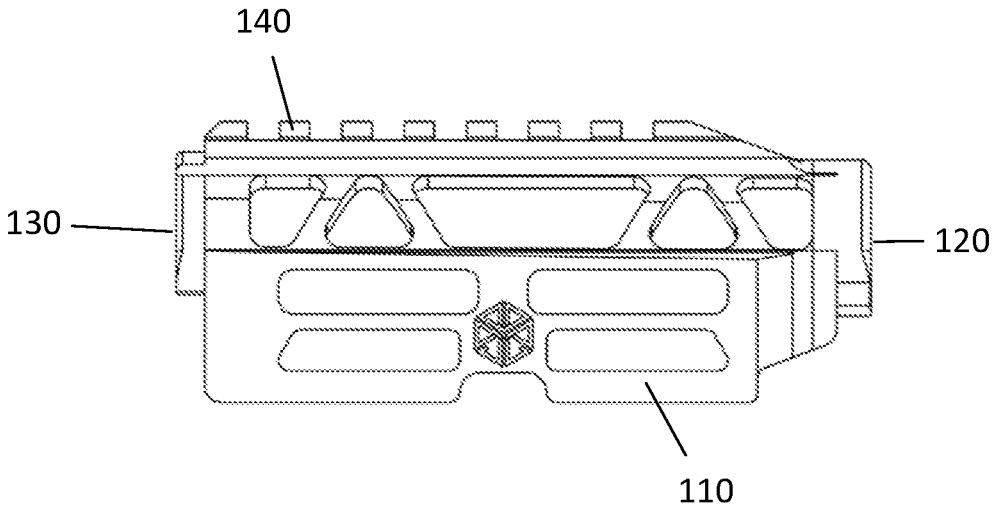
FIG. 11B is a side view of the upper component of the handguard assembly.
Figure 11C:
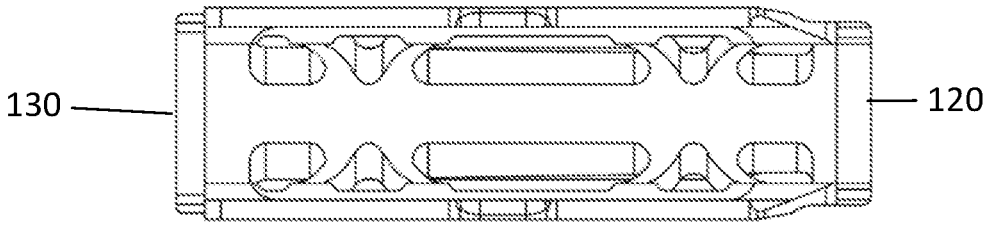
FIG. 11C is a bottom view of the upper component of the handguard assembly.

Referring to FIGS. 10-11C, the preferred embodiment of the upper component 100 is illustrated. The upper component 100 may be any size and shape. The upper component 100 is generally U-shaped with an open bottom for receiving the gas tube 22 of the firearm. The upper component has a front opening 120 and a rear opening 130 through which the gas tube 22 passes. In the preferred embodiment the front opening 120 is vertically lower than the rear opening 130 so that the gas tube 22 passes through the upper component at a downward angle. In other embodiments the front opening 120 and rear opening 130 are positioned at the same height and the gas tube 22 is not forced into a downward angle. The upper component also has one or more tabs 110 on each side of the upper component 100. The tabs 110 of the upper component 100 fit into the slots 210 of the lower component 200. As illustrated, the upper component has a picatinny rail 140. In other embodiments the upper component 100 does not have a picatinny rail 140.

Figure 12:
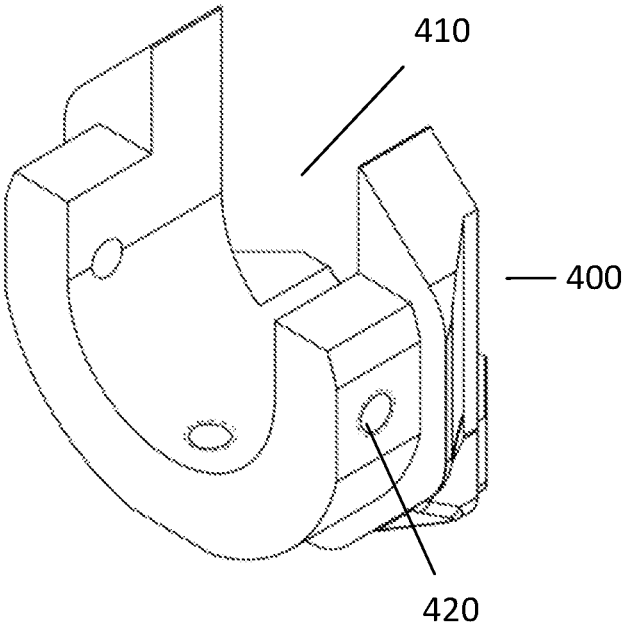
FIG. 12 is a top perspective view of the rear cap of the handguard assembly.
Figure 13A:
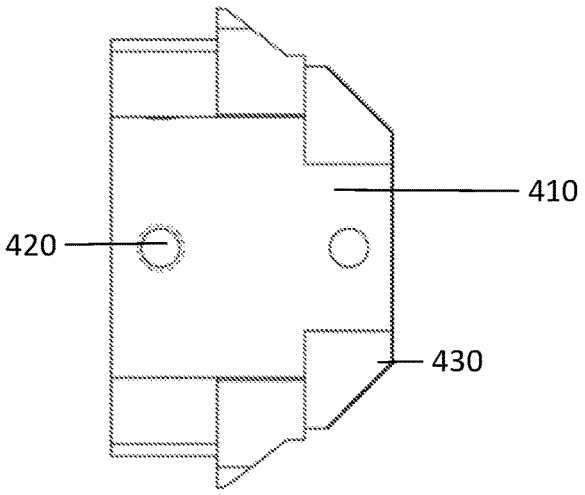
FIG. 13A is a top view of the rear cap of the handguard assembly.
Figure 13B:
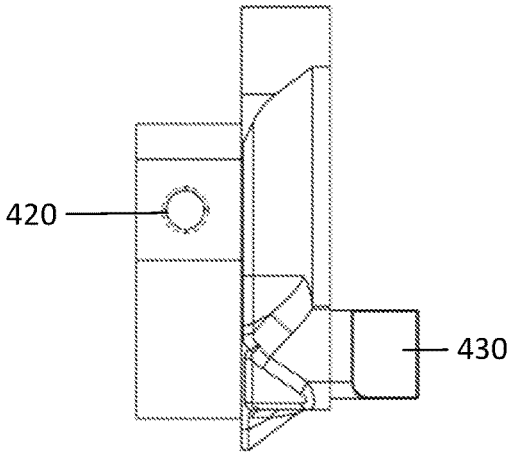
FIG. 13B is a side view of the rear cap of the handguard assembly.
Figure 13C:
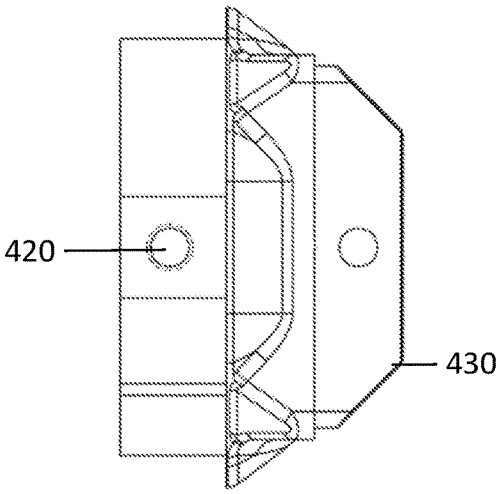
FIG. 13C is a bottom view of the rear cap of the handguard assembly.

Referring to FIGS. 12-13C, the rear cap 400 is illustrated. The rear cap 400 has a rear cap top side 410 that is U-shaped for receiving the barrel 24 of the firearm 20. The rear cap 400 has screw holes 420 for receiving the screws 500 to attach the lower component 200 to the rear cap 400. The rear cap 400 has a rear tab 430. The rear tab 430 may be any size and shape and is preferably utilized to attach the rear cap 400 to the lower receiver of the firearm 20.

Figure 14:
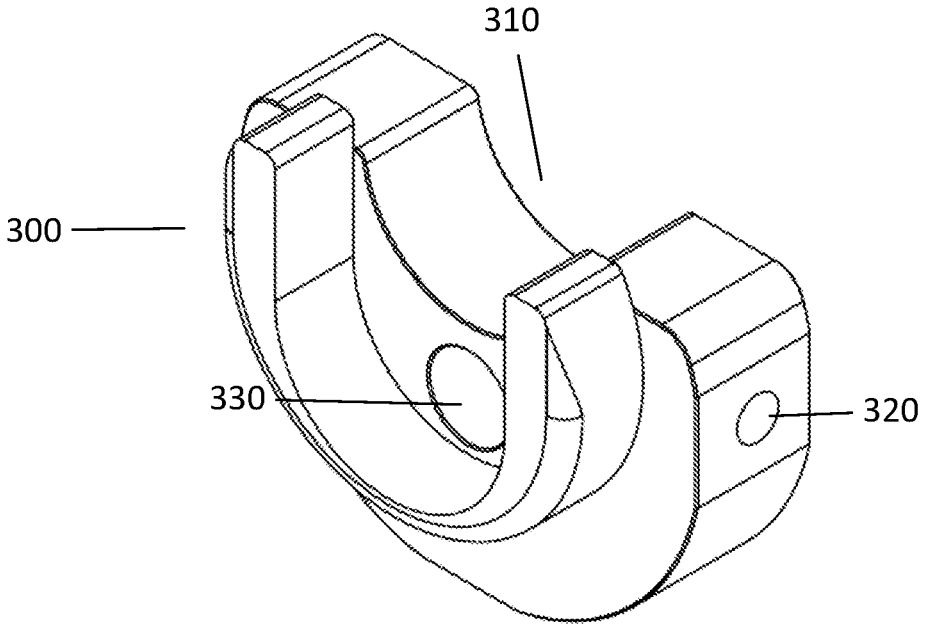
FIG. 14 is a top perspective view of the front cap of the handguard assembly.
Figure 15A:
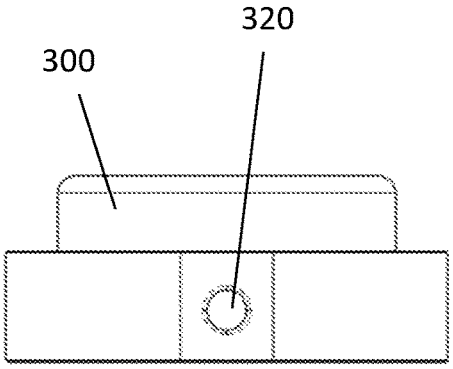
FIG. 15A is a bottom view of the front cap of the handguard assembly.
Figure 15B:
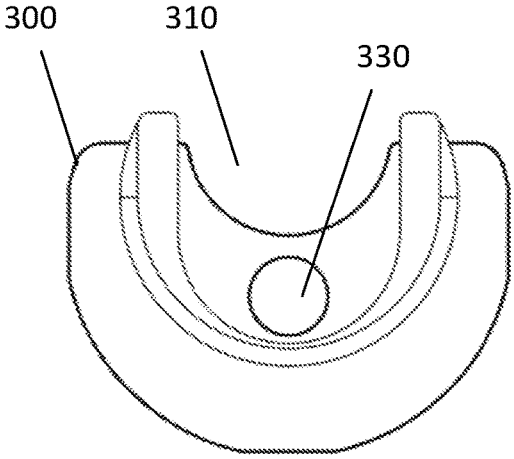
FIG. 15B is a front view of the front cap of the handguard assembly.
Figure 15C:
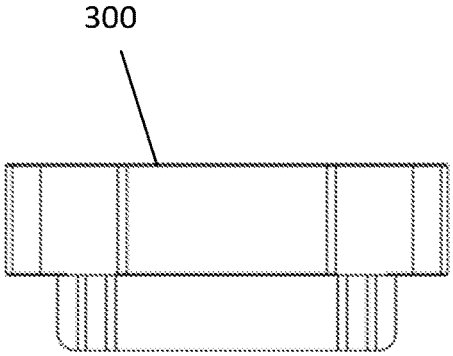
FIG. 15C is a top view of the front cap of the handguard assembly.

Referring to FIGS. 14-15C, the preferred embodiment the front cap 300 is illustrated. The front cap 300 has a front cap top side 310 that is U-shaped for receiving the barrel 24 of the firearm 20. The front cap top side 310 is higher than the rear cap top side 410 to force the barrel into an upward angle. In other embodiments the front cap top side 310 is at another position which does not force the barrel 24 into an upward angle. The front cap 300 has one or more screw holes 320 for receiving the screws 500 so the lower component 200 can be attached to the front cap 300. In some embodiments the front cap 300 has a circular hole 330 passing through the body of the front cap 300. The circular hole 300 permits the cleaning rod 40 to pass through front cap 300.

Figure 16:
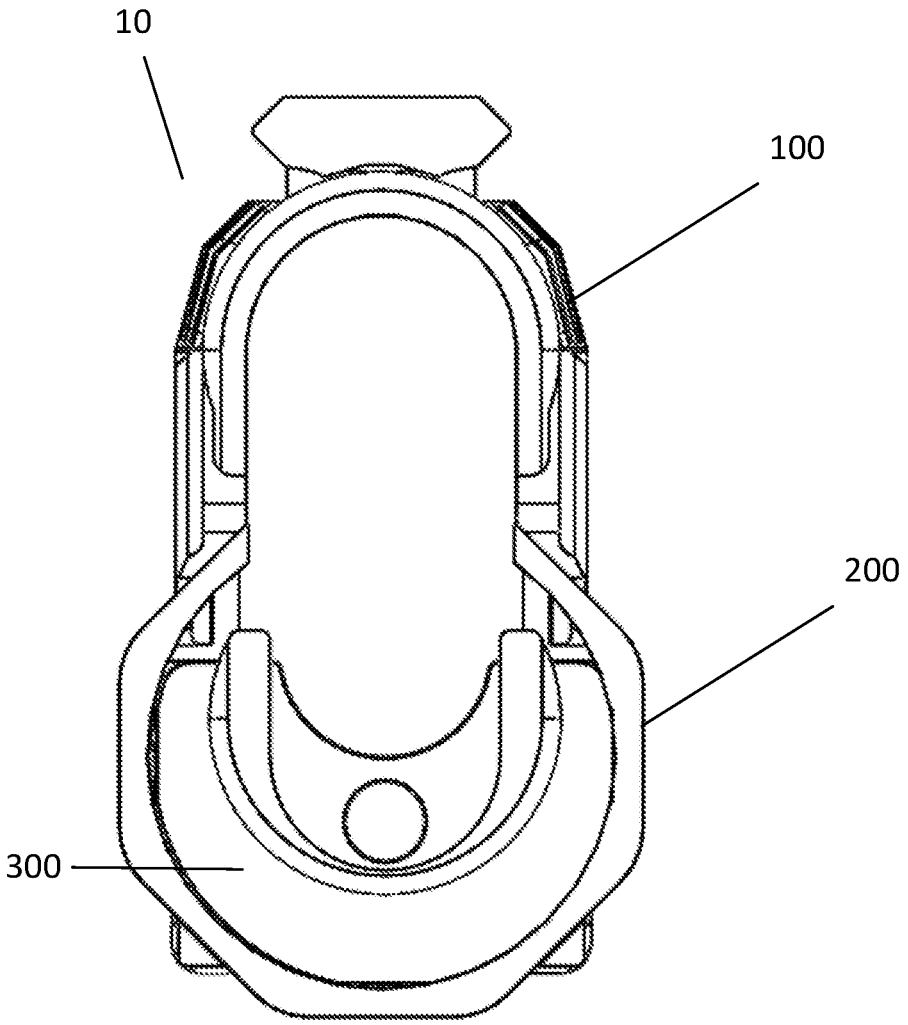
FIG. 16 is a front view of the handguard assembly.
Figure 17A:
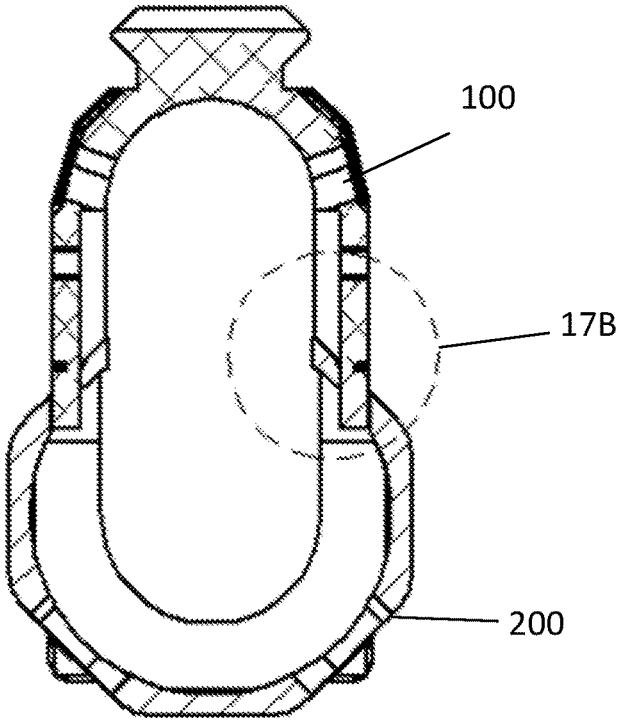
FIG. 17A is a cross-section view of the handguard assembly.
Figure 17B:
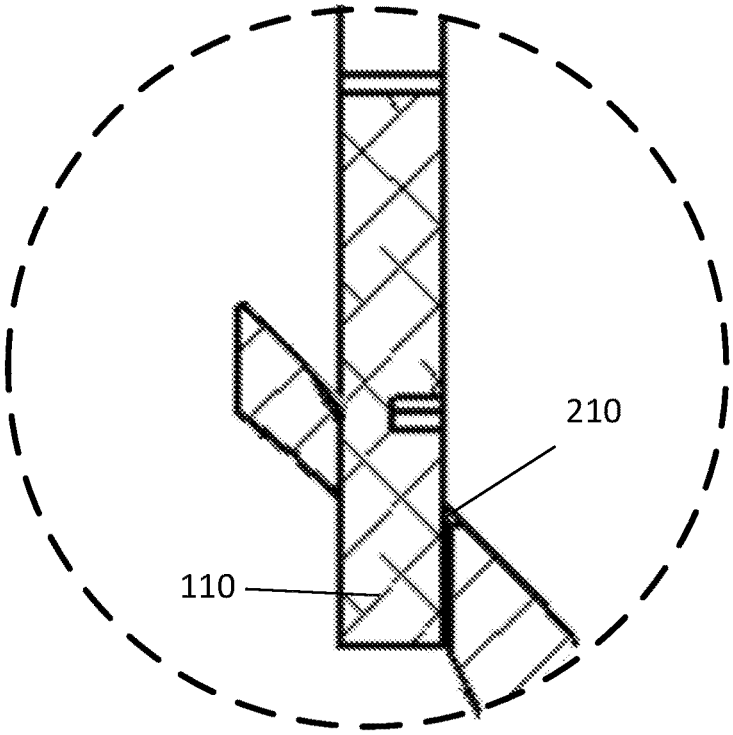
FIG. 17B is an enhanced cross-section view of a portion of the handguard assembly.
Figure 18:
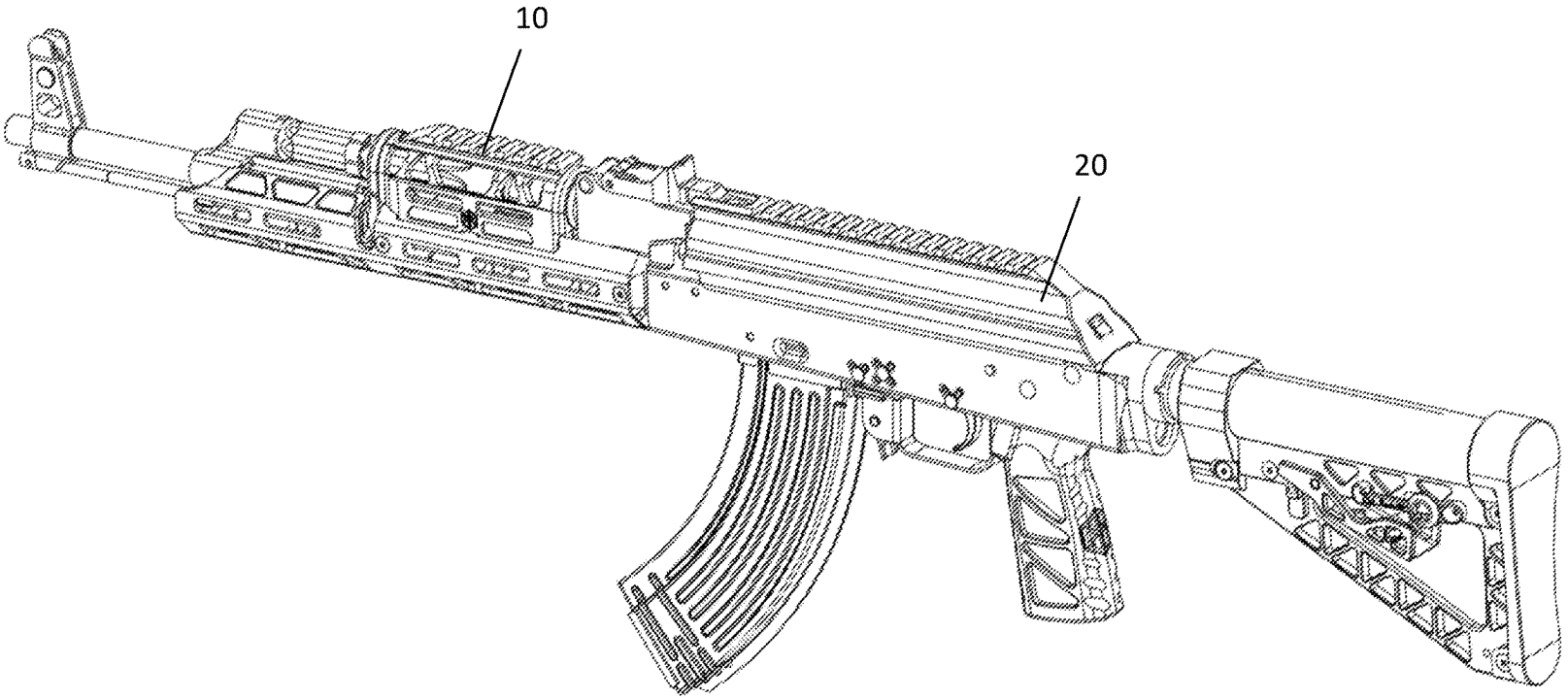
FIG. 18 is a perspective view of an alternative embodiment of the handguard assembly mounted on a firearm.
Figure 19:
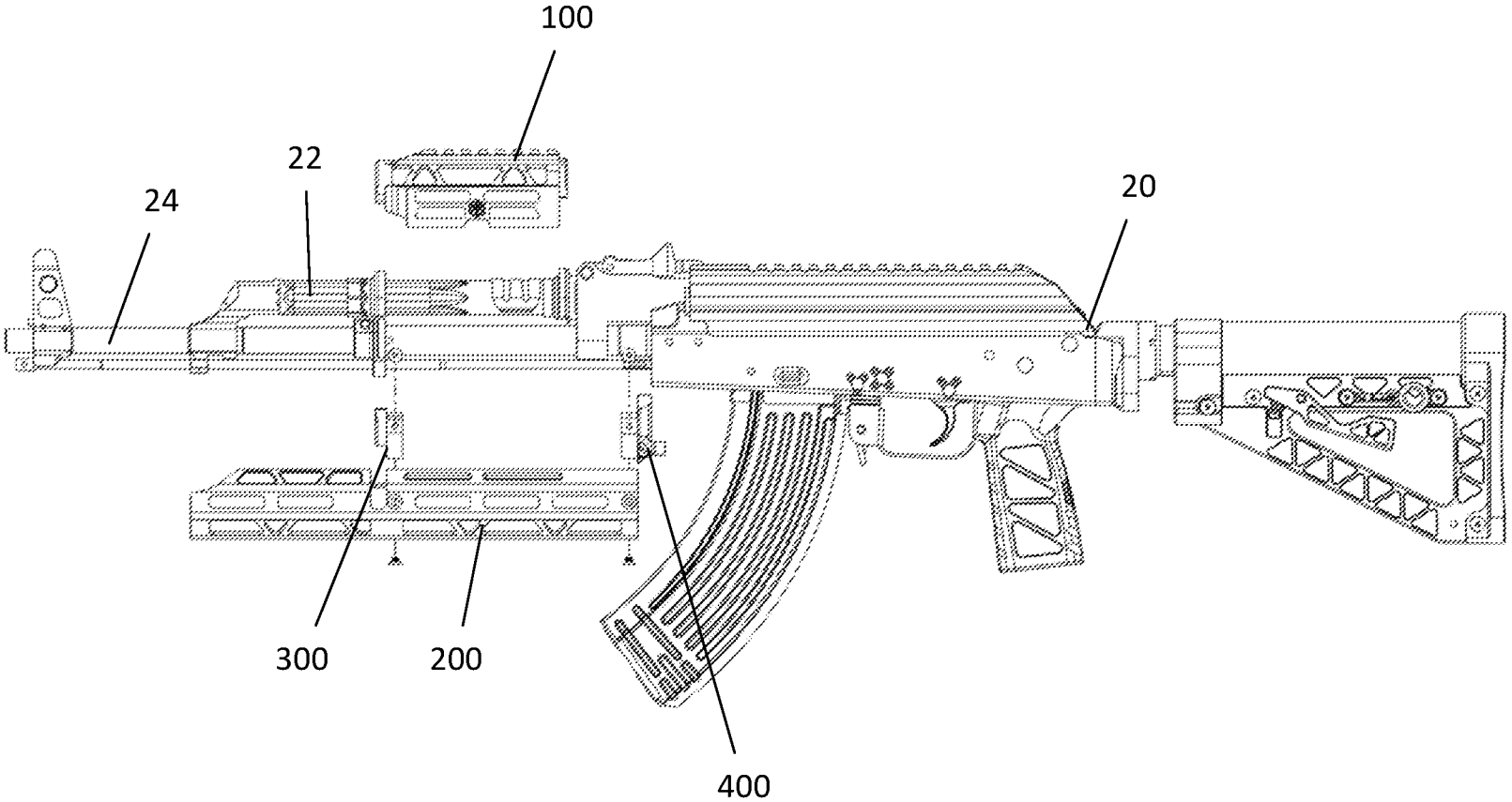
FIG. 19 is an exploded side view of an alternative embodiment of the handguard assembly mounted on a firearm.
Figure 20:
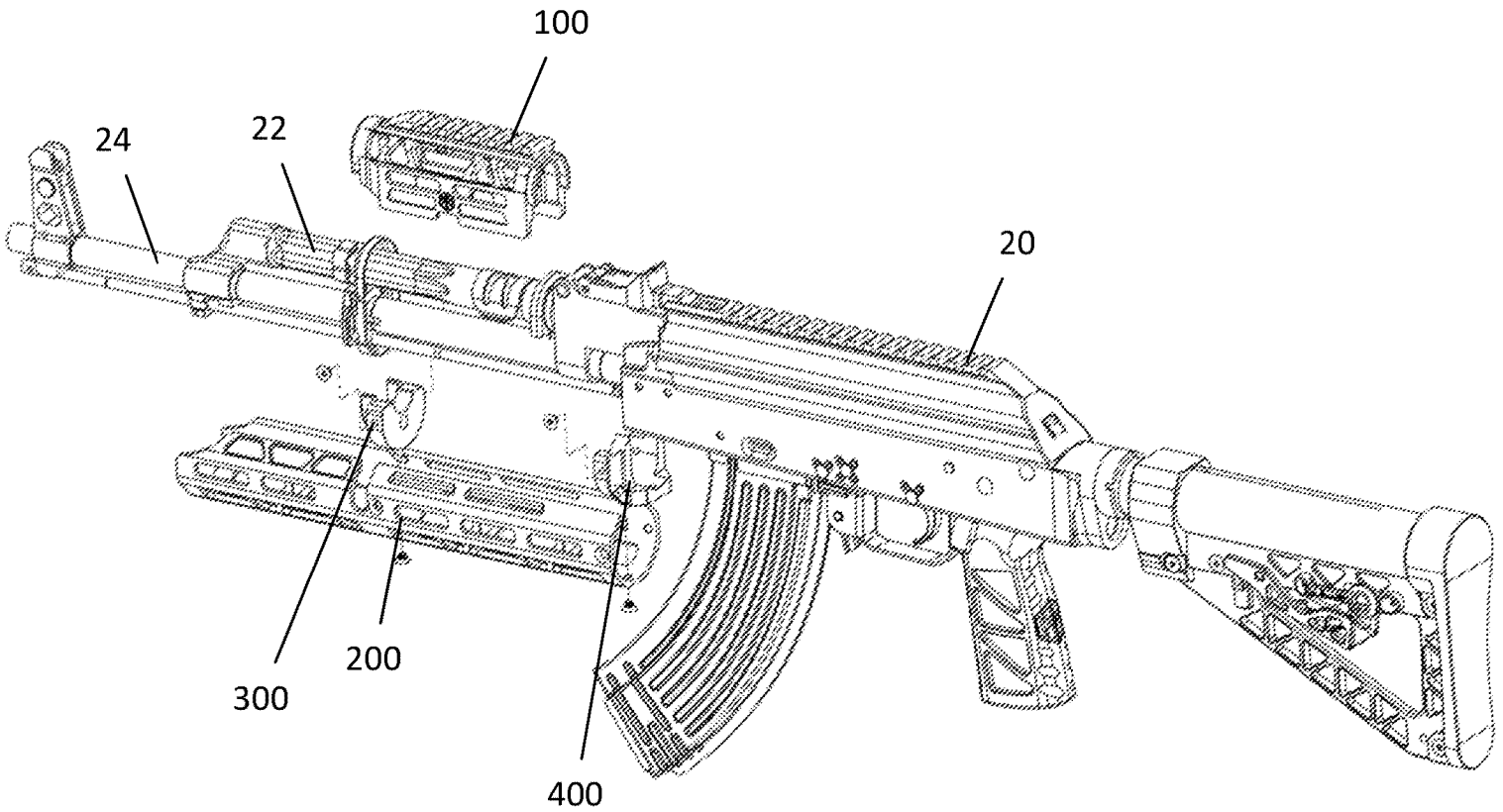
FIG. 20 is an exploded perspective view of an alternative embodiment of the handguard assembly mounted on a firearm.

As shown in FIGS. 16-17B, the upper component 100 fits together with the lower component 200. The front cap 300 is fully positioned within the lower component. As shown in FIG. 17B, the tabs 110 of the upper component 100 are secured within the slots 210 of the lower component 200.

Referring to FIGS. 18-21, the invention is illustrated in another embodiment. In this embodiment the lower component 100 is longer and extends further along the barrel 24. The operation of the invention in this embodiment is the same regardless of the longer lower component 100.

Figure 21:
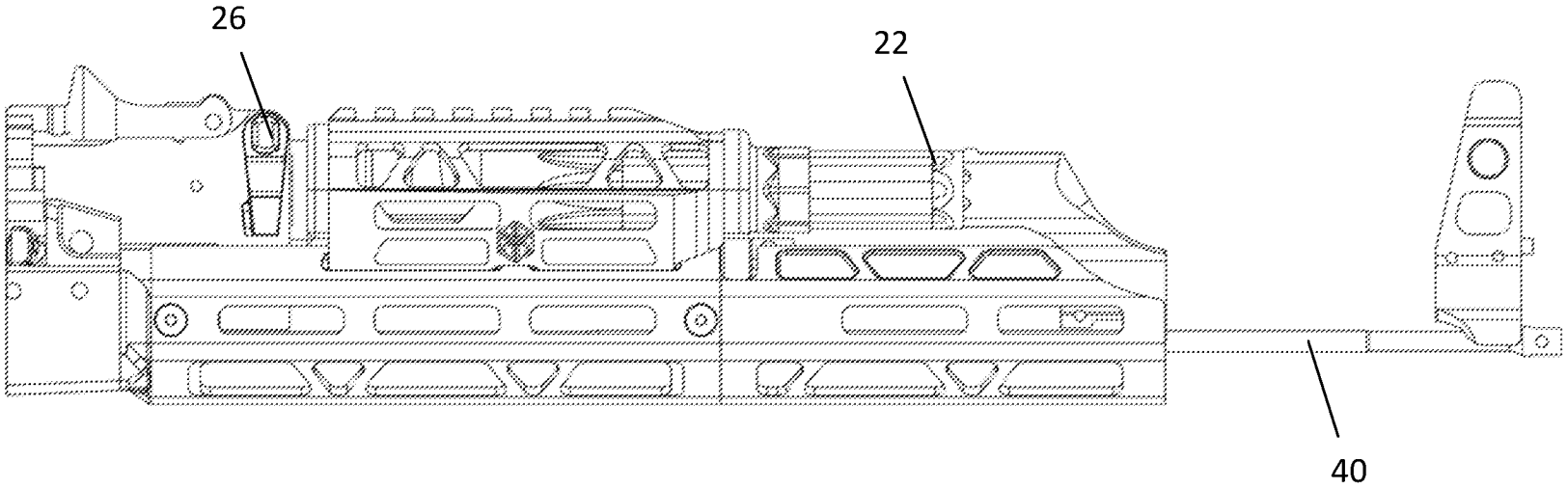
FIG. 21 is a side view of an alternative embodiment of the handguard assembly mounted on a firearm.
Figure 22:
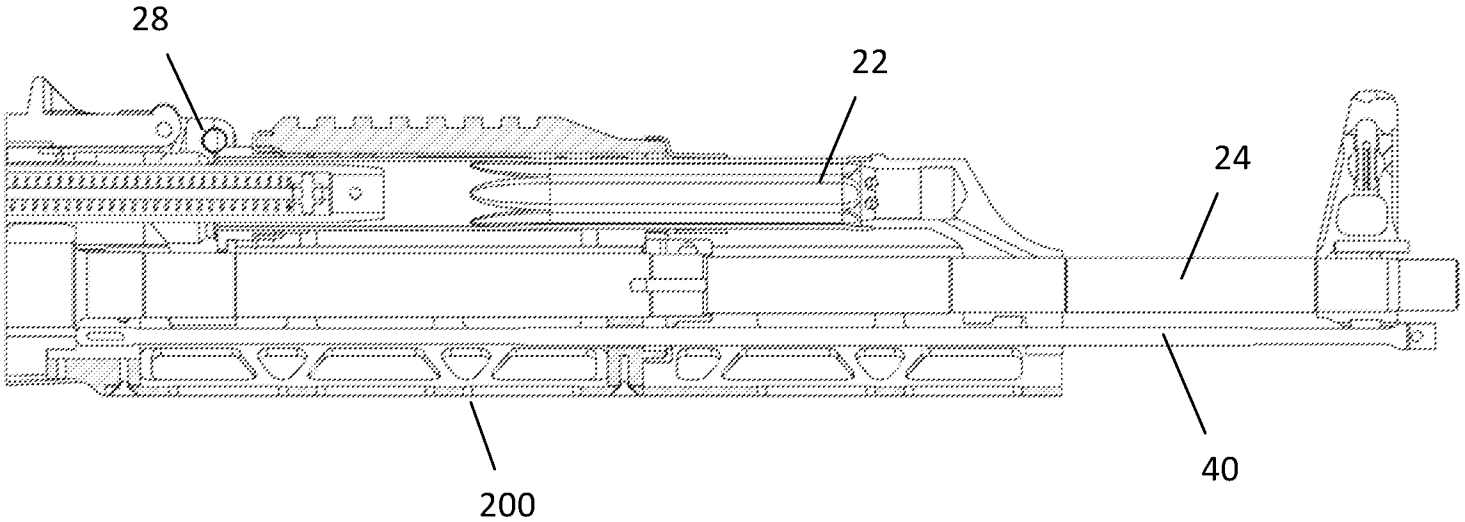
FIG. 22 is a cross-section view of an alternative embodiment of the handguard assembly mounted on a firearm.

Referring to FIGS. 21 and 22, the position of the upper component 100 and lower component 200 on the firearm 20 are illustrated. The upper component 100 is locked into place by the gas tube lock 26. The gas tube lock 26 forces the upper component 100 to push down on the lower component 200. The angles of the structure of the upper component 100 and lower component 200 cause the upper component 100 to squeeze the lower component 200. This squeezing action forces the alignment of the upper component 100 and lower component 200. This, in turn, forces proper alignment of barrel 24 with the gas tube 22, zeroing the front sight 30 and rear sight 32. The structure of the handguard assembly 10 is such that a user may remove and reinstall the assembly without losing mounted sights zero. As shown in FIG. 22, the gas tube lock 26 fits within the locking hole 28. The gas tube lock 26 is utilized to lock the gas tube 22 into proper position in the upper receiver of the firearm 20.

Figure 23:
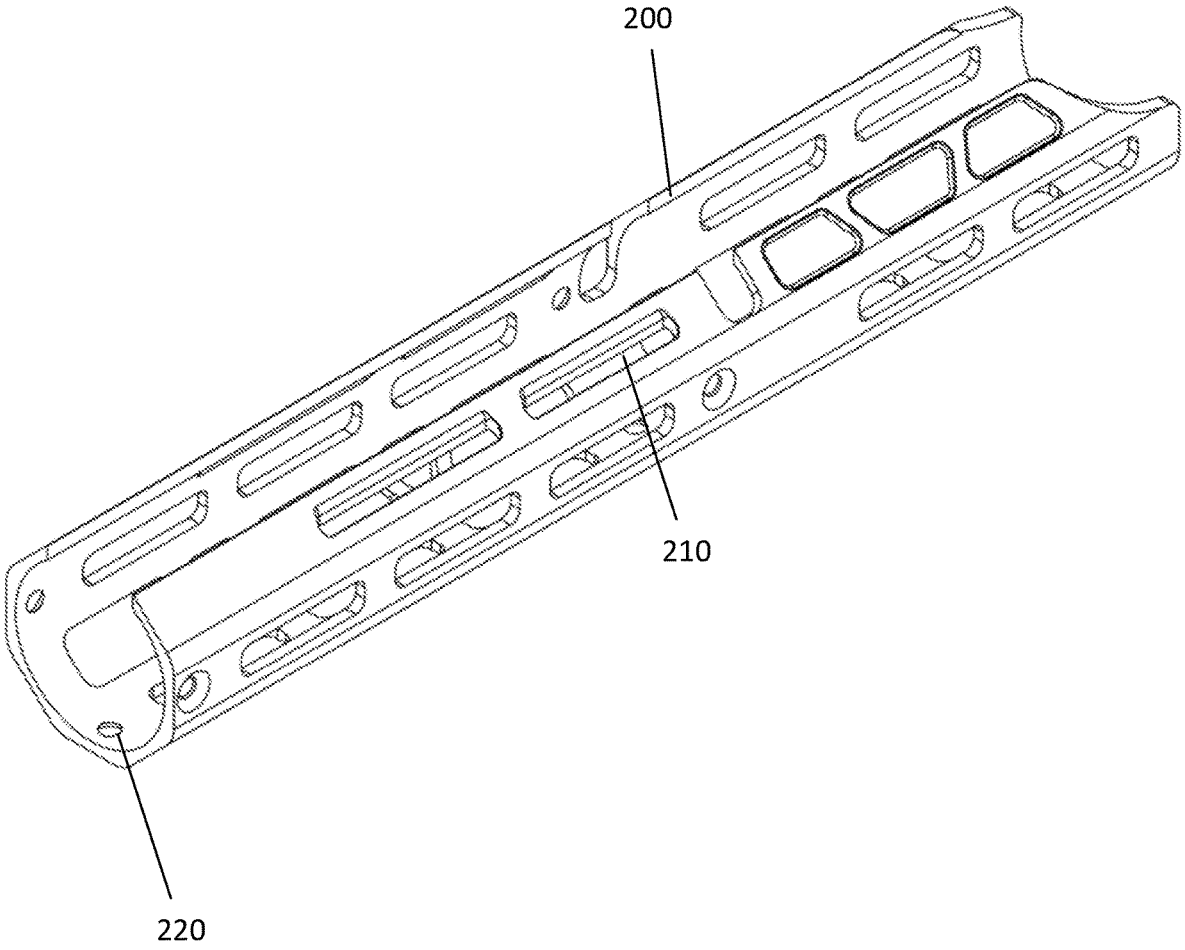
FIG. 23 is a perspective view of the lower component of the alternative embodiment of the handguard assembly.
Figure 24A:
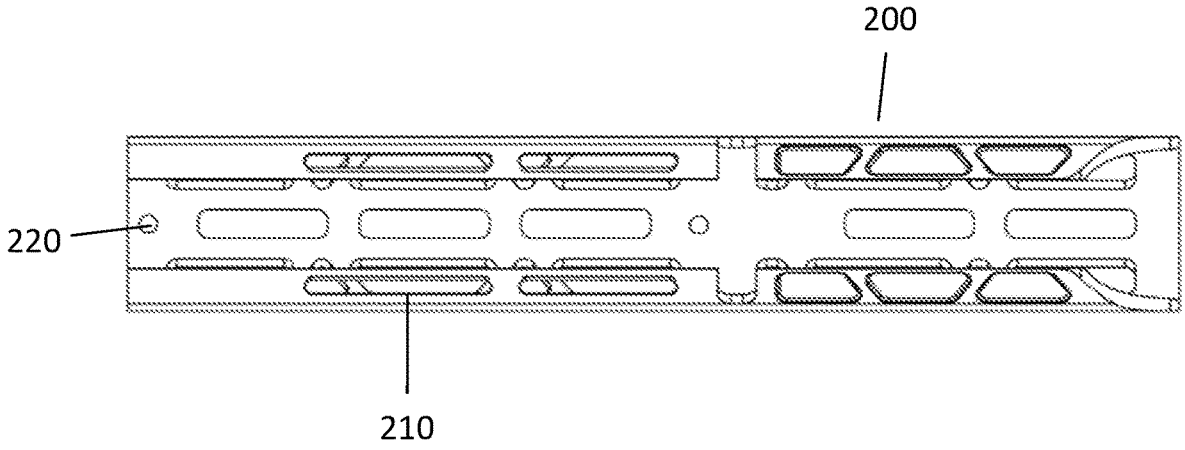
FIG. 24A is a top view of the lower component of the alternative embodiment of the handguard assembly.
Figure 24B:
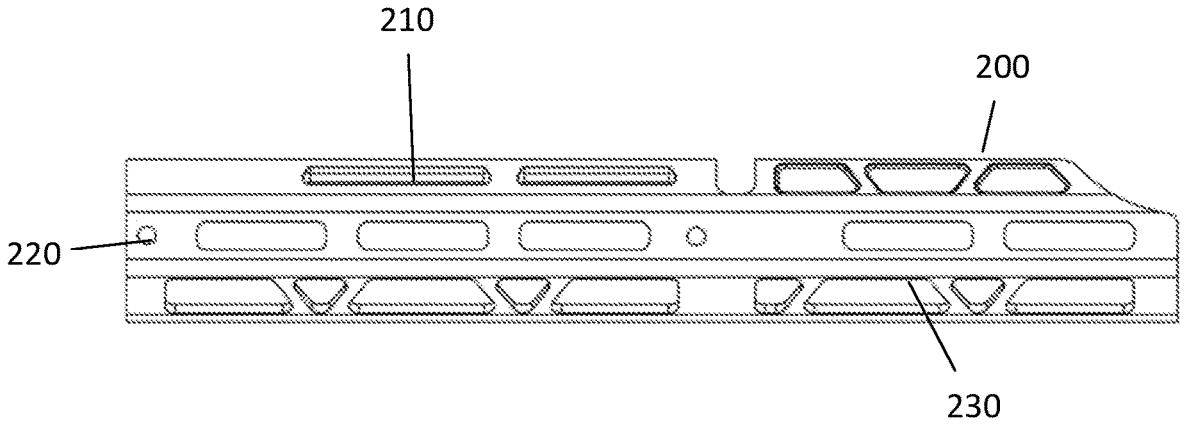
FIG. 24B is a side view of the lower component of the alternative embodiment of the handguard assembly.

Referring to FIGS. 23-24B, the elongated lower component 200 is illustrated. The elongated lower component 200 comprises slots 210, screw holes 220, and apertures 230.

When the tabs 110 of the upper component 100 are fit within the slots 210 of the lower component 200, the tabs 110 pull the sides of the lower component 200 inward, causing the lower component 200 to apply pressure to the front cap 300 and rear cap 400 and squeeze the barrel 24. The entire assembly thus becomes locked into optimal place where the sights are zeroed. In this embodiment the distance between the tabs 110 on the opposite sides of the upper component 100 is less than the distance of the slots 210 on the opposite sides of the lower component 200. In other embodiments this distance may be equal or greater than the distance of the slots 210 on the opposite sides of the lower component 200.

To utilize the invention, the user inserts the front cap 300 and rear cap 400 into the lower component 200. The user utilizes the screws 500 to secure the lower component 200 to the front cap 300 and the rear cap 400. In some embodiments the front cap 300 and rear cap 400 are part of the lower component 200 rather than separate components. In other embodiments the front cap 300 and rear cap 400 are already attached to the lower component 200. The user then positions the lower component 200 against the lower receiver and inserts the barrel 24 into the lower component 200. The user ensures that the front cap top side 310 and rear cap top side 410 engages the barrel 24. The user then places the upper component 100 over the gas tube 22. The user inserts the tabs 110 of the upper component 100 into the slots 210 of the lower component 200. At this point in time the sights are zeroed. The user can fire the firearm 20. The user can then ensure that the sights are zeroed by confirming the location of a hit on a target Other embodiments are possible without varying from the core of the invention. For instance, the screws 500 may be any size and shape or may be replaced by other fastening members.

What has been described above includes examples of the claimed subject matter. It is, of course, not possible to describe every conceivable combination of components or methodologies for purposes of describing the claimed subject matter, but one of ordinary skill in the art can recognize that many further combinations and permutations of such matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

The foregoing method descriptions and the process flow diagrams are provided merely as illustrative examples and are not intended to require or imply that the steps of the various embodiments must be performed in the order presented. As will be appreciated by one of skill in the art the order of steps in the foregoing embodiments may be performed in any order. Words such as "thereafter," "then," "next," etc. are not intended to limit the order of the steps; these words are simply used to guide the reader through the description of the methods. Further, any reference to claim elements in the singular, for example, using the articles "a," "an" or "the" is not to be construed as limiting the element to the singular.

The preceding description of the disclosed embodiments is provided to enable any person skilled in the art to make or use the present invention. Various modifications to these embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the following claims and the principles and novel features disclosed herein.

What is claimed is:

1. A handguard assembly for a firearm comprising a) an upper component comprising
  i) a top portion connected to a first side wall and a second side wall;
  ii) an internal cavity defined by said first side wall and said second side wall;
    (1) wherein said first side wall has one or more tabs disposed at a bottom end;
    (2) wherein said second side wall has one or more tabs disposed at a bottom end;
  iii) a front opening;
  iv) a rear opening;

b) a lower component comprising
  i) a first side
  ii) a second side disposed adjacent to said first side;
  iii) an opening along a length of said lower component defined by said first side and said second side;
    (1) wherein said first side has one or more slots disposed in said first side;
    (2) wherein said second side has one or more slots disposed in said second side;

c) a front cap having a curved top side;

d) a rear cap having a curved top side;

e) wherein said one or more tabs of said first side wall of said upper component are removably disposed within said one or more slots of said first side of said lower component;

f) wherein said one or more tabs of said second side wall of said upper component are removably disposed within said one or more slots of said second side of said lower component;

g) wherein said upper component and said lower component position a barrel of said firearm into a position where said firearm is in a zero sights state; and h) wherein the upper component is adapted to pull the first side of the lower component toward the second side of the lower component when the one or more tabs of said first side wall of said upper component are removably disposed within said one or more slots of said first side of said lower component and when the one or more tabs of said second side wall of said upper component are removably disposed within said one or more slots of said second side of said lower component.

2. The handguard assembly as in claim 1 a) wherein said first side wall of said upper component and said first side of said lower component are joined at a non-perpendicular angle; and b) wherein said second side wall of said upper component and said second side of said lower component are joined at a non-perpendicular angle.

3. The handguard assembly as in claim 1 wherein a first distance between said one or more tabs on said first side wall of said upper component and said one or more tabs on said second side wall of said upper component is less than a second distance between said one or more slots in said first side of lower component and said one or more slots in said second side of said lower component.

4. The handguard assembly as in claim 1 wherein said front cap and said rear cap are disposed within an internal cavity of said lower component.

5. The handguard assembly as in claim 4 wherein said front cap and said rear cap are removably secured to said lower component with a plurality of screws.

6. The handguard assembly as in claim 1 wherein a top front edge of said front opening of said upper component is lower than a top rear edge of said rear opening of said upper component when said handguard assembly is attached to said firearm.

7. The handguard assembly as in claim 1 wherein said top side of said front cap is higher than said top side of said rear cap when said handguard assembly is attached to said firearm.

8. The handguard assembly as in claim 2 wherein a first distance between said one or more tabs on said first side wall of said upper component and said one or more tabs on said second side wall of said upper component is less than a second distance between said one or more slots in said first side of lower component and said one or more slots in said second side of said lower component.

9. The handguard assembly as in claim 8 wherein said front cap and said rear cap are disposed within an internal cavity of said lower component.

10. The handguard assembly as in claim 9 wherein a top front edge of said front opening of said upper component is lower than a top rear edge of said rear opening of said upper component when said handguard assembly is attached to said firearm.

11. The handguard assembly as in claim 10 wherein said top side of said front cap is higher than said top side of said rear cap when said handguard assembly is attached to said firearm.

12. The handguard assembly as in claim 11 wherein said front cap and said rear cap are removably secured to said lower component with a plurality of screws.

13. A method of zeroing sights on a firearm comprising a) attaching a handguard assembly to a firearm, wherein said firearm assembly comprises i) an upper component comprising (1) a top portion connected to a first side wall and a second side wall;

(2) an internal cavity defined by said first side wall and said second side wall;

(a) wherein said first side wall has one or more tabs disposed at a bottom end;

(b) wherein said second side wall has one or more tabs disposed at a bottom end;

(3)a front opening;

(4) a rear opening;

ii) a lower component comprising (1) a first side (2) a second side disposed adjacent to said first side;

(3) an opening along a length of said lower component defined by said first side and said second side;

(a) wherein said first side has one or more slots disposed in said first side;

(b) wherein said second side has one or more slots disposed in said second side;

iii) a front cap having a curved top side;

iv) a rear cap having a curved top side;

v) wherein said one or more tabs of said first side wall of said upper component are removably disposed within said one or more slots of said first side of said lower component;

vi) wherein said one or more tabs of said second side wall of said upper component are removably disposed within said one or more slots of said second side of said lower component;

vii) wherein the upper component is adapted to pull the first side of the lower component toward the second side of the lower component when the one or more tabs of said first side wall of said upper component are removably disposed within said one or more slots of said first side of said lower component and when the one or more tabs of said second side wall of said upper component are removably disposed within said one or more slots of said second side of said lower component; and viii) wherein said upper component and said lower component position a barrel of said firearm into a position where said firearm is in a zero sights state;

b) firing said firearm at a target location;

c) confirming sights of said firearm are zeroed by confirming a hit at said target location.

14. The method as in claim 13, further comprising turning a gas tube lock to force said upper component into a predetermined position relative to said lower component.

15. The method as in claim 14, wherein turning the gas tube lock to force said upper component into the predetermined position relative to said lower component engages the upper component with the lower component by forcing the upper component down onto the lower component;

wherein the upper component comprises one or more angled surfaces; and wherein, when the upper component is engaged with the lower component by being forced down onto the lower component, the one or more angled surfaces of the upper component apply a squeezing action to the lower component thereby forcing the upper component and the lower component into alignment.

16. The method as in claim 15, wherein the firearm comprises a barrel and a gas tube;

wherein the upper component is operationally engaged with the gas tube;

wherein the lower component is operationally engaged with the barrel; and wherein forcing the upper component and the lower component into alignment forces proper alignment of the barrel with the gas tube.

17. The handguard assembly as in claim 1, wherein the upper component is adapted to be engaged with the lower component by being forced down onto the lower component.

18. The handguard assembly as in claim 16, wherein the upper component comprises one or more angled surfaces;

wherein, when the upper component is engaged with the lower component by being forced down onto the lower component, the one or more angled surfaces of the upper component apply a squeezing action to the lower component sufficient to force the upper component and the lower component into alignment.

* * * * *